United States Patent [19]

Bohmer

[11] Patent Number: 4,587,820

[45] Date of Patent: May 13, 1986

[54] ROLL HEAD FOR A PLANETARY CROSSROLLING MILL

[75] Inventor: Friedhelm Bohmer, Grevenbroich, Fed. Rep. of Germany

[73] Assignee: SMS Schloemann-Siemag Aktiengesellschaft, Dusseldorf, Fed. Rep. of Germany

[21] Appl. No.: 518,813

[22] Filed: Jul. 29, 1983

[30] Foreign Application Priority Data

Aug. 5, 1982 [DE] Fed. Rep. of Germany ..... 3229211

[51] Int. Cl.[4] ..... B21B 31/18

[52] U.S. Cl. ..... 72/78

[58] Field of Search ..... 72/77, 78, 99, 100, 72/125, 126

[56] References Cited

U.S. PATENT DOCUMENTS 3,718,020 2/1973 Leitner ..... 72/78

3,735,617 5/1973 Bretschneider ..... 72/78

FOREIGN PATENT DOCUMENTS 2748770 5/1979 Fed. Rep. of Germany ..... 72/78

*Primary Examiner*—Lowell A. Larson

*Attorney, Agent, or Firm*—Holman & Stern

[57] ABSTRACT

A roll head for a planetary crossrolling mill in which the roll shaft bearing the tapered roll is mounted at one end close to the tapered roll in a radial bearing and an axial bearing while the other end rests with teeth in a rotationally engaged but axially movable manner in a hollow shaft of a bevel wheel driving the roll shaft. To obtain a compact structure with arrangement of the components on paths of revolution with small radii, the support ring of the axial bearing is provided with two sets of facial teeth pointing in opposite directions and can be coupled alternately with one of two coupling rings, wherein one coupling ring with the support ring can be connected in a rotationally engaged manner for its axial adjustment with the roll shaft while the other coupling ring with the support ring for securing its position can be connected to the thrust collar of the axial bearing which, in turn, rests in a rotationally enaged but axially movable manner in the roll head housing, and the radial bearing arranged before the axial bearing accommodates the axial adjustment of the roll by a change in position between internal and external bearing rings or in its seat by changing position of the external ring in the roll head housing.

19 Claims, 4 Drawing Figures

ROLL HEAD FOR A PLANETARY CROSSROLLING MILL

BACKGROUND OF THE INVENTION

1. Field of the Invention

The invention relates to a roll head for a planetary crossrolling mill wherein the mounting and adjustment of the shafts bearing the tapered rolls is in cantilever fashion, which produces an axially and radially compact structure, that is to say, in the latter case, a structure which dispenses with components which do not act as direct supports.

2. Description of the Prior Art

Planetary crossrolling mills are used as so-called high-reduction rolling mills for rolling out solid and hollow cross-sections, in particular for marked reduction of cross-section, in order to bring the material to be rolled much closer to the desired final cross-section in a single pass. The rolling forces to be applied are correspondingly high. Planetary cross-rolling mills generally consist of three roll heads each bearing a tapered roll and resting in a rotor with which they revolve round the material to be rolled so that the tapered rolls can make a reduction in the cross-section. For this purpose, the tapered rolls are arranged with their axes inclined to the axis of the material to be rolled and their axes cross the axis of the material to be rolled at a short distance. On a hollow shaft, through which the material to be rolled reaches the tapered rolls, there is located a sun wheel on which there run planetary wheels which drive the respective roll shaft via an intermediate wheel, a tapered pinion and a bevel wheel in each case. The adjustment and obliqueness of the rolls, the diameter of the material to be rolled and the speed of the rotor can only be adjusted for one respective condition to prevent the material to be rolled from rotating about its axis. To prevent the material to be rolled from twisting under other conditions, the hollow shaft traversed by the material to be rolled is accordingly rotated forwards or backwards.

Particular importance is attached to the roll heads revolving round the material to be rolled with the rotor as they are exposed to high rolling forces and high centrifugal forces. The centrifugal forces are directly proportional to the distances at which the components are arranged relative to the axis of the material to be rolled and they increase with the square of the angular velocity, which directly determines the throughput of the rolling mill. As a result, the components, in particular the heavy components, should be arranged at as small a distance from the axis of the material to be rolled, as is permitted by the roll geometry determined by the diameter of the material to be rolled and the reduction of roll passes. For this purpose, a rolling head design of the type disclosed in the proceedings of the ILAFA Rolling Mill Congress, published by the Instituto Latinoamericano del Fierro y el Acero, May 1980, page H 9/10, FIG. 26, has proven advantageous. According to this prior art there are provided a radial bearing and an axial bearing of a very strong design, in which is supported one end of the roll shaft which bears the tapered roll at this end in a cantilever fashion while, at its other end, the roll shaft is rotationally engaged, but axially movably inserted in the bevel wheel of the roll drive mechanism mounted in the roll head housing. A support ring for the axial bearing which is inserted rotatably in the roll head housing and is rotatable for the axial adjustment of the roll is arranged between the bearings (radial and axial bearing) and the bevel wheel. To enable the support ring to rotate, it is coupled via a clutch to the bevel wheel driving the roll, while the support ring is fixed non-rotatably in the roll head housing during rolling via the same clutch. A bush which is provided externally with the adjusting thread and contains the bearings (radial and axial bearing) in its bore acts as a support ring.

The design of the support ring as a bush demands a roll head which is larger by twice the wall thickness of the bush, and, with predetermined roll head dimensions, only permits bearings which must remain in diameter smaller than bearings of maximum conceivable diameters by twice the wall thickness of the bush.

SUMMARY OF THE INVENTION

According to the invention there is provided a roll head for a planetary cross-rolling mill comprising;

a roll head housing;

a roll shaft journalled in said housing and disposed, in operation, obliquely to the axis of the material to be rolled;

a radial bearing and an axial bearing in said housing supporting said shaft adjacent to a first end of the shaft;

a tapered roll mounted in cantilever manner on said first shaft end;

a driving bevel wheel rotatably mounted in said housing, said bevel wheel receiving said shaft at a second end thereof remote from said first end in a manner such that said shaft is movable axially relative to said housing and is constrained to rotate with said bevel wheel;

a driving transmission for coupling said bevel wheel to head driving means of said mill;

a support ring in said housing, directly supporting said axial bearing on that side thereof that is opposite said first shaft end;

a stationary screw thread in said housing, said support ring having a screw thread in mesh with said stationary screw thread whereby rotation of said support ring effects axial adjustment of said support ring and thereby of said roll shaft and roll;

and clutch means for selectively coupling the said support ring to said bevel wheel, for rotation thereby for effecting said adjustment of the support ring, or to a stationary thrust ring of said axial bearing for locking said support ring in position during rolling;

said radial bearing being disposed in a position preceding said axial bearing and having an internal bearing ring supporting the roll shaft, at least said internal bearing ring of said radial bearing being axially movable in said roll head housing whereby said radial bearing accommodates the axial adjusting movement of the said roll by axial change of position between at least said internal bearing ring of the radial bearing and said roll head housing.

More specifically said radial bearing accommodates the axial adjusting movement of the roll either within the radial bearing itself by change of position between an internal bearing ring of the radial bearing and an external ring of the radial bearing, or within the seating of said radial bearing by change of position in said roll head housing of an external bearing ring of said radial bearing, i.e., of the entire bearing.

Preferably the clutch means comprise a first and second coupling rings provided with respective face teeth, of which the first coupling ring is in driven relation with the bevel gear and the second coupling ring is rotationally fast with the thrust ring, said clutch means further comprising further face teeth rotationally fast with the support ring and facing respectively in opposite directions and means for effecting relative axial movement of said face teeth whereby in a first clutch means position the support ring is coupled to the first coupling ring and hence to the bevel gear for rotating the support ring and in a second clutch means position the support ring is coupled to the second coupling ring and hence to the thrust ring for locking the support ring against rotation.

BRIEF DESCRIPTION OF THE DRAWINGS

The invention will now be described in detail with reference to the accompanying drawings wherein.

In each illustrated embodiment of the invention, three identical roll heads are mounted in a rotor (shown in outline and designated by 1) and rotate with the rotor in a stator (not shown). Structures of rotor and stator are known, for example from the publication already mentioned as prior art, or from the prior art according to German Offenlegungsschrift No. 31 12 781.9 or German Offenlegungsschrift No. 31 13 461.0.

Figure 1:
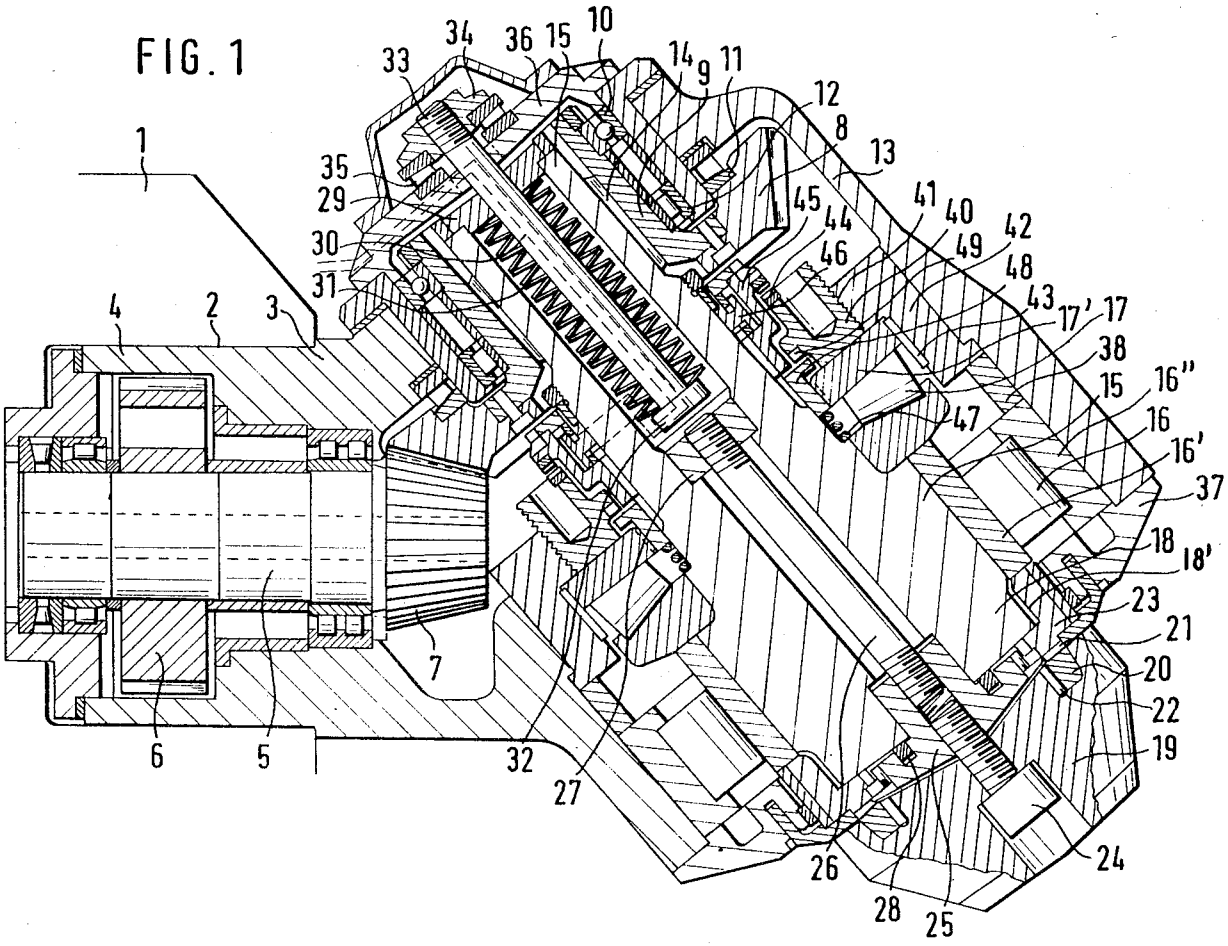
FIGS. 1 to 3 are axial cross sectional views of three roll heads embodying the invention.
Figure 2:
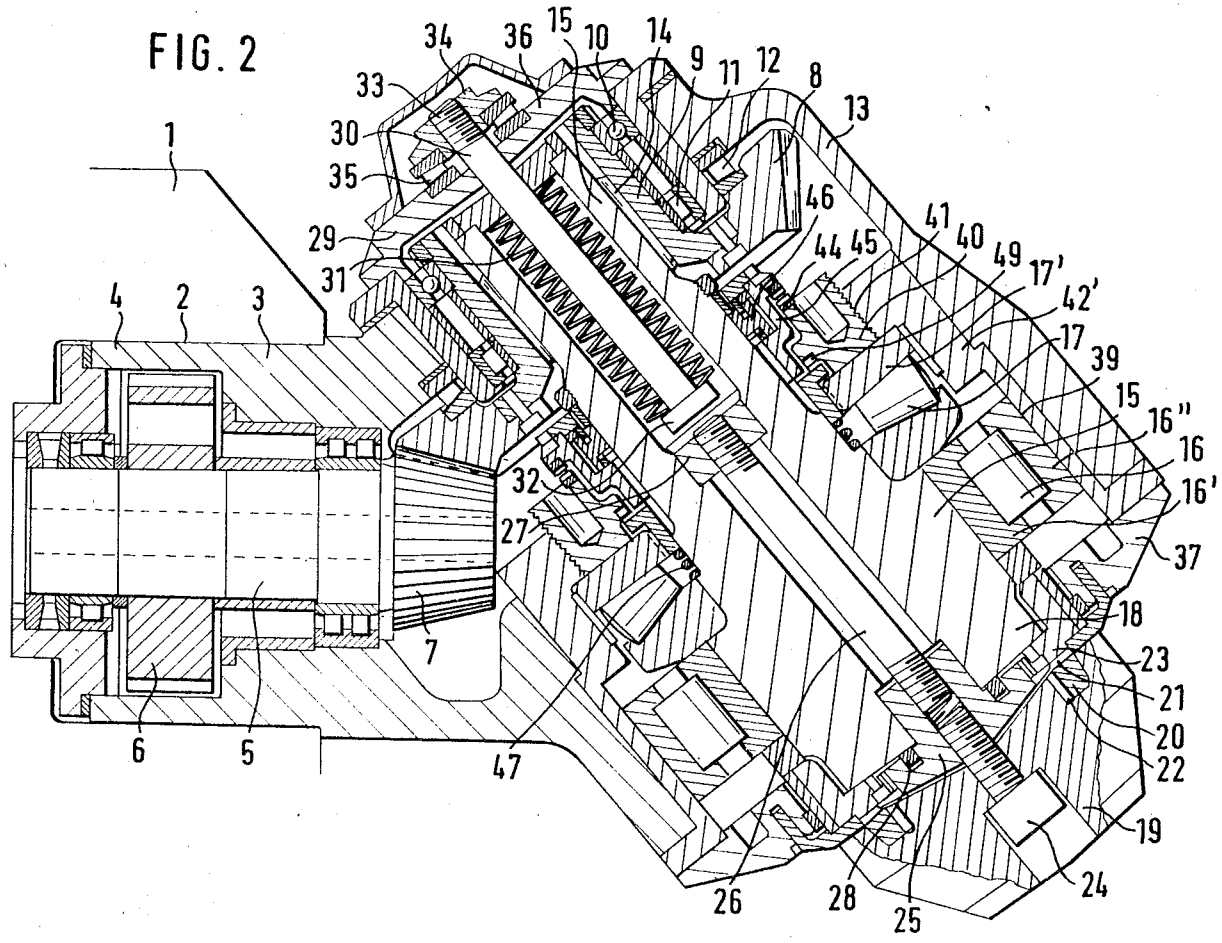
Figure 3:
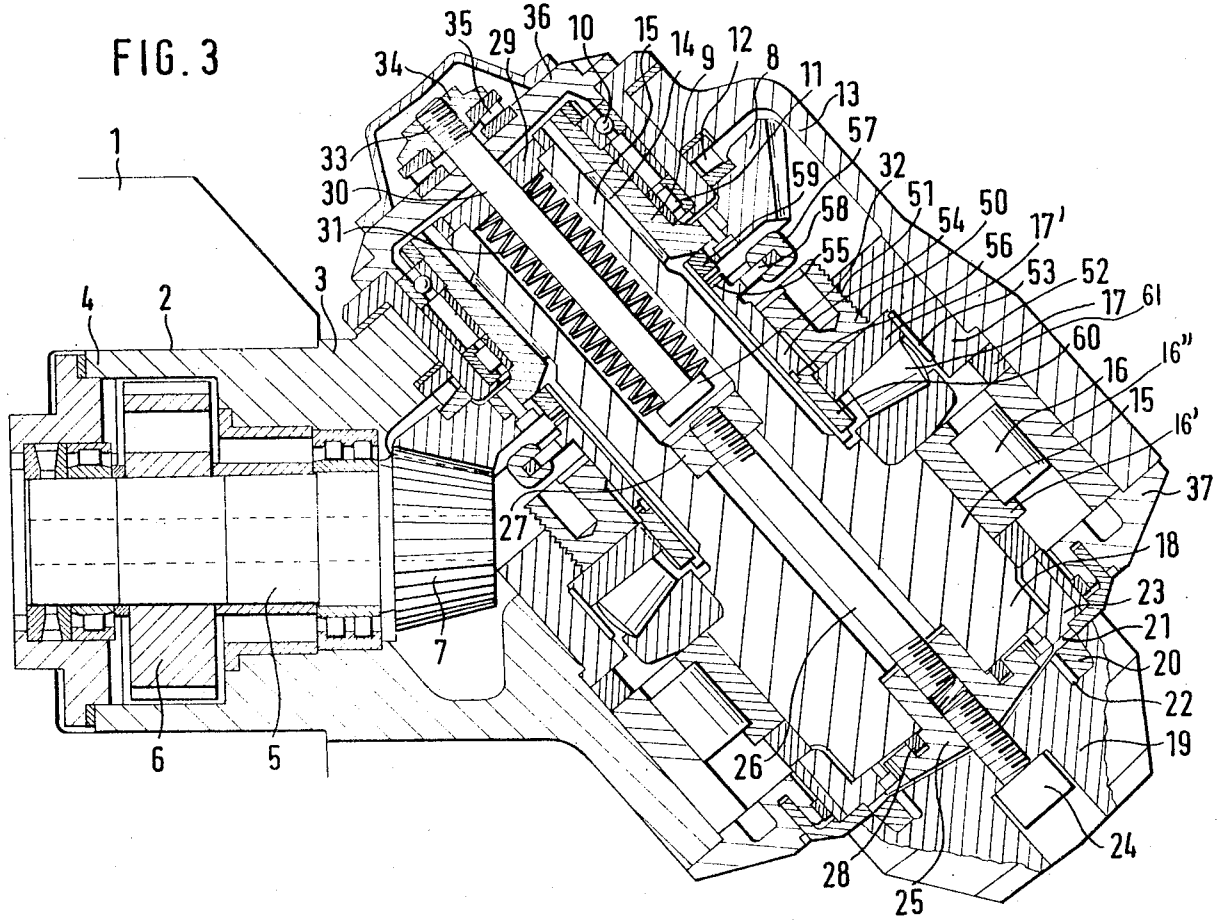

The embodiments according to FIGS. 1, 2 and 3 have the common feature that a roll head 3 with its cylindrical projection 4 rests pivotally in a bore 2 in a rotor which is shown in outline and designated by 1. An intermediate shaft 5 is mounted in the pivot axis in the cylindrical projection 4 and engages by an intermediate wheel 6 a planetary wheel which is not shown mounted in the rotor 1 and which runs on a sun wheel which is not shown, the intermediate shaft 5 being rotated during rotation of the rotor 1 and/or of the sun wheel. The intermediate shaft 5 is also provided with a tapered pinion 7 which engages a bevel wheel 8. The bevel wheel 8 is connected to a hollow shaft 9 and is mounted with it in the roll head housing 13 by radial bearing 10 and an axial bearing 12. The hollow shaft 9 is provided over the length of its bore with internal teeth 14 in which the end of a roll shaft 15 having corresponding teeth is relatively non-rotatably but longitudinally movably guided and centered. The front end of the roll shaft 15 is supported via a radial bearing 16 and an axial bearing 17 in the roll head housing 13. A journal 18 of the roll shaft 15 projecting from the portion adjacent the radial bearing 16 and having external teeth 18' bears a cantilevered tapered roll 19. The tapered roll 19 is provided with an inserted ring 20 which has teeth on its face 21 and is secured against rotation relative to roll 19 by pins 22. An internally toothed cap 23 which secures the internal ring of the bearing 16 axially relative to the roll shaft 15 is placed on the externally toothed journal 18 of the roll shaft 15. The cap 23 is also provided with teeth on its face corresponding to the teeth on the face 21 and thus produces the rotationally engaged connection of the tapered roll 19 with the roll shaft 15. The tapered roll 19 is held on the roll shaft 15 by a screw 24 which is screwed into a nut member 25 into which there is also screwed one end of a tie rod 26 whose other end is screwed into a nut 27. The nut member 25 is designed as an annular cylinder for receiving an annular piston 28 whose load extends the tie rod 26 so that after tightening the screw 24 and subsequent release of the annular piston 28, the tension of the tie rod 26 secures the tapered roll 19 via the ring 20 and the cap 23 against the end face of the roll shaft 15 on its journal 18. To ensure that the roll shaft rests in the axial bearing 17 in a continuous firmly engaged manner, the hollow roll shaft 15 is sealed by a cover 29 at the end away from the tapered roll 19, the cover 29 having a bore as a passage for a spring bolt 30. A spring 31 in the bore of the roll shaft 15 is clamped between the cover 29 and a collar 32 on the spring bolt 30, for which purpose the spring bolt 30 acts, by way of a nut 34 on its threaded shank 33, via an axial bearing 35 on a cover 36 sealing the roll head housing 13 at the end away from the tapered roll 19.

In the embodiment according to FIG. 1, a support ring 40, which is provided with an externnal screw thread 41 and is inserted rotatably in the threaded bore of an insert, or thust, ring 42 in the roll head housing 13, is provided for the axial bearing 17. The insert ring 42 is secured in and against relative rotation with respect to the roll head housing 13 and within the insert ring 42, the thrust collar 17' of the axial bearing 17 is also secured against rotation with respect to ring 42 by round keys 43. The axial bearing 17 and with it the roll shaft 15 with the tapered roll 19 is therefore axially adjusted by the rotation of the support ring 40. For this purpose, the support ring 40 is provided with teeth on its face 44 and can be coupled via a coupling ring 45 which rests in a rotationally engaged but axially movable manner on the roll shaft 15 and has corresponding teeth on its face for facial meshing with the teeth on face 44 of the support ring 40 so that the support ring 40 is also rotated by the rotation of the roll shaft 15. To actuate the coupling ring 45 there is fixed on the roll shaft 15 a ring 46 receiving in recesses on both end faces annular pistons which by alternate loading, by hydraulic pressure for example, as shown schematically by dashed lines in FIG. 1, engage the coupling ring 45 in the teeth on face 44 of the support ring 40 and disengage it therefrom. When the coupling ring 45 is in the disengaged position, a second coupling ring 48, inserted in non-rotatable but axially movable engagement in the thrust collar 17' of the axial bearing 17, follows it under the influence of the spring 47 and, in the process, engages with corresponding facial teeth in secondary facial teeth 49 on the support ring 40 so that the support ring 40 is secured against unintentional rotation in this position. During axial adjustment of the roll shaft 15, the internal ring 16' of the radial bearing 16 moves relative to the cylindrical rollers fixed axially in the external ring 16''. The external ring 16'' of the axial bearing 16 is held in the bore of the roll head housing 13 between a spacing ring 38 and a cover 37 sealing the roll heading housing 13 on the roll side.

The embodiment shown in FIG. 2 corresponds to the one shown in FIG. 1, but the radial bearing 16 does not allow axial movement within itself as both the internal ring 16' and the external ring 16'' are provided with shoulders which axially fix the rollers. For this purpose, the external ring 16'' of the radial bearing 16 is axially movably fitted in the bore 39 of the insert, or thrust, ring 42', extended to the end face of the roll head housing.

Figure 4:
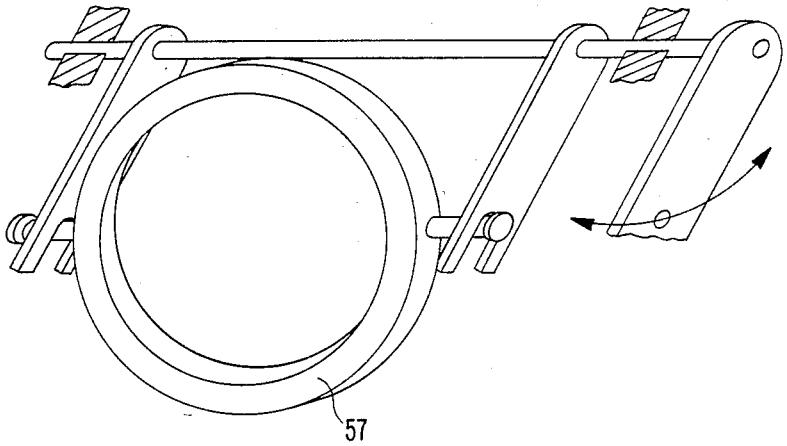
FIG. 4 is a schematic perspective view of a mechanical linkage for operating a claw to actuate the adjuster.

In the embodiment according to FIG. 3, a support ring designated by 50 is provided for the axial bearing 17 and is equipped with an external thread 51 and engages rotatably in the threaded bore of an insert, or thrust, ring 52 in the roll head housing 13. The insert, or thrust, ring 52 is secured against rotation in the roll head housing 13 and the thrust collar 17' of the axial bearing 17 is again secured against rotation by round keys 53. The axial bearing 17 and, with it, the roll shaft 15 with the tapered roll 19 is thus axially adjusted by rotation of the support ring 50. The support ring 50 is divided for this purpose, and the internal ring 54 to the support ring 50 rests in it in a rotationally engaged but axially movable manner and is provided on both end faces with facial teeth 55 and 56. The axial adjustment is effected via a claw 57 which is movable parallel to the axis of the roll shaft 15 in a manner known per se such shown schematically in FIG. 4 for example, and acts on the coupling disc 58 which forms part of the internal ring 54 of the support ring 50. In one position, the facial teeth 55 of the internal ring 54 engage in corresponding facial teeth of a coupling ring 59 on the internal rim of the crown of the bevel wheel 8 and thus connect the bevel wheel 8 to the support ring 50 for axial adjustment of the axial bearing 17 with the roll shaft 15 and the tapered roll 19. In the other position, the facial teeth 56 engage in the corresponding facial teeth on the coupling ring 60 which, on the one hand, is held in a rotationally engaged but axially movable fashion in the thrust collar 17′ of the axial bearing 17 and, on the other hand, is held rotatably but axially unmovably on a guide sleeve connected to the crown of the bevel wheel 8 so as to secure the support ring 50 against unintentional rotation. During axial movement of the roll shaft 15, the rollers which are held axially by the shoulders of the internal ring 16′ of the radial bearing 16 move in the external ring 16″ which is axially fixed in the bore of the roll head housing 13 by a spacer ring 61 and the sealing cover 37.

I claim:

1. A roll head for a planetary cross-rolling mill comprising:

a roll head housing;

a roll shaft journalled in said housing and disposed, in operation, obliquely to the axis of the material to be rolled;

a radial bearing and an axial bearing having a thrust collar mounted in said housing and supporting said shaft adjacent to a first end of the shaft;

a tapered roll mounted in cantilever manner on said first end of said shaft;

a driving bevel wheel rotatably mounted in said housing, said bevel wheel receiving said shaft at a second end thereof remote from said first end in a manner such that said shaft is movable axially relative to said housing and is constrained to rotate with said bevel wheel;

a driving transmission for coupling said bevel wheel to head driving means of said mill;

a support ring in said housing, directly supporting said axial bearing on that side thereof that is opposite said first end of said shaft;

a stationary screw thread in said housing, said support ring having a screw thread in mesh with said stationary screw thread whereby rotation of said support ring effects axial adjustment of said support ring and thereby of said roll shaft and roll; and clutch means for selectively coupling said support ring to said bevel wheel, for rotation thereby for effecting said adjustment of the support ring, or to the thrust collar of said axial bearing for locking said support ring in position during rolling;

said radial bearing being disposed in a position between said axial bearing and said first end of said roll shaft and having an internal bearing ring supporting the roll shaft, at least said internal bearing ring of said radial bearing being axially slidably movable in said roll head housing whereby said radial bearing accommodates the axial adjusting movement of said roll by axial change of position between at least said internal bearing ring of the radial bearing and said roll head housing.

2. A roll head for a planetary cross-rolling mill according to claim 1 wherein said clutch means comprise first and second coupling rings provided with respective face teeth, said first coupling ring being in driven relation with the bevel gear and said second coupling ring being rotationally fast with said thrust collar, said clutch means further comprising further face teeth rotationally fast with the support ring and respectively facing in opposite directions for selective engagement with the face teeth of said first and second coupling rings respectively, and means for effecting relative axial movement of said face teeth, so that in a first clutch means position the support ring is coupled via the first coupling ring to the bevel gear for rotating the support ring to adjust the roll axially, and in a second clutch means position the support ring is coupled via the second coupling ring to the thrust collar for locking the support ring against rotation.

3. A roll head according to claim 2, wherein said first coupling ring rests in a rotationally engaged but axially movable manner on the roll shaft and is arranged to move the second coupling ring, said second coupling ring being freely rotatable relative to the first coupling ring axially, during the axial movement of said first coupling ring, and said coupling rings in their extreme positions of axial movement selectively cause reciprocal engagement of respective face teeth of the support ring with the face teeth of one or the other coupling ring.

4. A roll head according to claim 3, wherein said roll shaft is provided with a ring collar thereon and said means for effecting relative axial movement of said face teeth comprises means supported on said ring collar to move said first coupling ring axially.

5. A roll head according to claim 3 wherein said means for effecting relative axial movement of said face teeth comprises an annular piston arranged to effect said axial movement in one direction and means for effecting reverse axial movement in the opposite direction.

6. A roll head as in claim 5 wherein said means for effecting reverse axial movement comprises a second annular piston.

7. A roll head as in claim 5 wherein said means for effecting reverse movement comprises at least one spring.

8. A roll head according to claim 7 and further comprising spring means between the second coupling ring and the thrust ring of the axial bearing, acting in the direction of the engagement position of the second coupling ring, the first coupling ring being so disposed that in its engagement position the first coupling ring keeps the second coupling ring disengaged against the force of said spring.

9. A roll head according to claim 2 and further comprising spring means acting on the second coupling ring relative to the thrust collar of the axial bearing, acting in the direction of the engagement position of the second coupling ring, the first coupling ring being so disposed that in its engagement position the first coupling ring keeps the second coupling ring disengaged against the force of said spring.

10. A roll head according to claim 2, wherein said support ring is provided with an internal ring which is rotationally engaged but axially movable therein and which is provided with said face teeth pointing in opposite directions, said support ring being connected, by axial movement of said insert ring, selectively to the bevel wheel which incorporates said first coupling ring or to said second coupling ring which is mounted in a rotationally engaged but axially movable manner in the thrust collar of the axial bearing.

11. A roll head as claimed in claim 2 wherein said radial bearing has an external bearing ring disposed fixedly in said housing, and an internal bearing ring movable axially relative to said external bearing ring.

12. A roll head as claimed in claim 2 wherein said radial bearing is axially movable bodily in said housing.

13. A roll head for a planetary cross-rolling mill according to claim 1 wherein said clutch means comprise first and second coupling rings provided with first and second face teeth, respectively, said first coupling ring being in driven relation with the bevel gear and having its first face teeth facing towards the support ring on one side of the latter and the second coupling ring being rotationally fast with said thrust collar, and having its second face teeth facing towards the support ring from the opposite side of the latter, said clutch means further comprising third and fourth face teeth rotationally fast with the support ring and facing in opposite directions towards said face teeth of said first and second coupling rings, respectively, and means for effecting relative axial movement of said face teeth whereby in a first clutch means position said first and third teeth are engaged and said second and fourth teeth are disengaged and in a second clutch means position said first and third teeth are disengaged and said second and fourth teeth are engaged.

14. A roll head according to claim 13, wherein said support ring is provided with an internal ring which is rotationally engaged but axially movable therein and which is provided with said face teeth pointing in opposite directions, said support ring being connected, by axial movement of said first coupling ring or to said second coupling ring which is mounted in a rotationally engaged but axially movable manner in the thrust collar of the axial bearing.

15. A roll head as claimed in claim 1 wherein said radial bearing has an external bearing ring disposed fixedly in said housing, and an internal bearing ring movable axially relative to said external bearing ring.

16. A roll head as claimed in claim 1 wherein said radial bearing is axially movable bodily in said housing.

17. In a roll head for a planetary cross rolling mill including, a roll head housing;

a roll shaft which is mounted in the housing at an inclination to the axis of the material to be rolled;

a radial bearing and an axial bearing provided with a thrust collar supporting a first end of the roll shaft; and a tapered roll mounted in cantilever fashion on said first end of said shaft and movable in an axial direction via the axial bearing for roll adjustment, the roll shaft having an opposite end mounted in a bevel wheel which is mounted in the roll head housing so that said opposite end is rotationally engaged but axially movable, said axial bearing being seated against a support ring disposed in the roll head housing adjustably in the axial direction of the roll shaft;

said support ring being in threaded engagement with a screw thread in said housing and can be coupled via a clutch means arranged between said support ring and the bevel wheel, selectively with a static element during the rolling operation, or with the bevel wheel for axial adjustment of the roll via the support ring, and wherein an intermediate shaft is mounted in the roll head housing parallel to the axis of the material to be rolled and connects the bevel wheel via a tapered pinion and an intermediate wheel to an associated planetary wheel in a driving manner;

the improvement comprising the support ring directly supports the thrust collar of the axial bearing and is provided with two oppositely directed face teeth which can be connected by relative axial movement alternately with two coupling rings having corresponding face teeth wherein one coupling ring can be connected in a rotationally engaged manner with the support ring for the axial adjustment of the support ring with the roll shaft or the bevel wheel driving the roll shaft, while the other coupling ring can be connected to the support ring for securing the position of the support ring with the thrust collar of the axial bearing which, in turn, is located in a rotationally but axially movable manner in the roll head housing, and the radial bearing is between the axial bearing and said first end of said roll shaft and allows for axial adjustment of the roll in itself.

18. A roll head as claimed in claim 17 wherein said radial bearing allows for said axial adjustment of the roll by relative movement between said internal and external bearing rings.

19. A roll head as claimed in claim 17 wherein said radial bearing allows for said axial adjustment of the roll by movement of said external bearing ring in the bore of the roll head housing with respect to said housing.

* * * * *